US010145156B2

(12) United States Patent
Aker

(10) Patent No.: US 10,145,156 B2
(45) Date of Patent: Dec. 4, 2018

(54) SWING BOLT LOCK MECHANISM FOR PREVENTING PREMATURE STATUS SWITCH ENABLING

(71) Applicant: KABA MAS, LLC., Lexington, KY (US)

(72) Inventor: Ross Aker, Lexington, KY (US)

(73) Assignee: KABA MAS, LLC, Lexington, KY (US)

( * ) Notice: Subject to any disclaimer, the term of this patent is extended or adjusted under 35 U.S.C. 154(b) by 533 days.

(21) Appl. No.: 14/782,258

(22) PCT Filed: Apr. 3, 2013

(86) PCT No.: PCT/US2013/035130
§ 371 (c)(1),
(2) Date: Oct. 2, 2015

(87) PCT Pub. No.: WO2014/163630
PCT Pub. Date: Oct. 9, 2014

(65) Prior Publication Data

US 2016/0047148 A1 Feb. 18, 2016

(51) Int. Cl.
*E05C 3/30* (2006.01)
*E05B 47/06* (2006.01)
(Continued)

(52) U.S. Cl.
CPC ..... *E05C 3/30* (2013.01); *E05B 15/102* (2013.01); *E05B 47/0603* (2013.01);
(Continued)

(58) Field of Classification Search
CPC ..... Y10T 292/1043; Y10T 292/1044; Y10T 292/1045; Y10T 292/1046;
(Continued)

(56) References Cited

U.S. PATENT DOCUMENTS 4,648,253 A * 3/1987 Imhoff ..... E05B 47/0047 292/341.15
6,139,073 A * 10/2000 Heffner ..... E05B 81/14 292/201
(Continued)

OTHER PUBLICATIONS

International Search Report and Written Opinion issued for PCT/US2013/035130, dated Jul. 2, 2013, 7 pages.

*Primary Examiner* — Alyson M Merlino
(74) *Attorney, Agent, or Firm* — Norton Rose Fulbright US LLP

(57) ABSTRACT

A swing bolt lock mechanism for preventing false status switch enabling is described. The lock mechanism is a swing bolt lock mechanism wherein the swing bolt has an inner ramp wall against which a blocker rod is spring-biased. A ramp extension arm is displaceably secured with the swing bolt and provides an extension of the ramp wall whereby the blocker rod may only be displaced when the swing bolt is at its fully locked position whereby to arrest the swing bolt at that position. The displacement of the blocker rod also toggles a lock status switch to provide an indication that the lock is at its locked position. Accordingly, the lock status switch cannot be prematurely actuated.

11 Claims, 5 Drawing Sheets

(51) Int. Cl.

| | |
|---|---|
| ***E05B 63/00*** | (2006.01) |
| ***E05B 65/00*** | (2006.01) |
| ***E05B 15/10*** | (2006.01) |
| ***E05C 3/00*** | (2006.01) |
| ***E05C 3/12*** | (2006.01) |
| ***E05C 3/14*** | (2006.01) |
| *E05B 17/20* | (2006.01) |
| *E05B 47/00* | (2006.01) |

(52) U.S. Cl.
CPC ..... *E05B 63/0013* (2013.01); *E05B 65/0075* (2013.01); *E05C 3/002* (2013.01); *E05C 3/124* (2013.01); *E05C 3/14* (2013.01); *E05B 17/2092* (2013.01); *E05B 2047/0069* (2013.01)

(58) Field of Classification Search
CPC ..... Y10T 292/1051; Y10T 292/1052; Y10T 292/1053; Y10T 292/1054; Y10T 292/1055; Y10T 292/1056; Y10T 292/1059; Y10T 292/106; Y10T 292/1061; Y10T 292/1048; Y10T 292/1049; Y10T 292/1062; Y10T 292/1075; Y10T 292/1076; Y10T 292/1077; Y10T 292/1079; Y10T 292/108; Y10T 292/1083; Y10T 292/1092; Y10T 292/702; Y10T 70/7062; Y10T 70/7102; Y10T 70/7107; Y10T 70/7113; Y10T 70/7915; Y10T 70/7927; Y10T 70/7932; E05C 3/30; E05C 3/00; E05C 3/002; E05C 3/004; E05C 3/124; E05C 3/14; E05C 3/145; E05B 15/102; E05B 15/104; E05B 15/105; E05B 15/108; E05B 47/0603; E05B 2047/0069; E05B 63/0013; E05B 65/0017; E05B 65/0075; E05B 17/2092
See application file for complete search history.

(56) References Cited

U.S. PATENT DOCUMENTS

| | | | | |
|---|---|---|---|---|
| 6,386,599 | B1 | 5/2002 | Chevalier | |
| 8,261,586 | B2 | 9/2012 | Gartner | |
| 9,845,618 | B2 * | 12/2017 | Worm | E05B 65/0075 |
| 2007/0252394 | A1 | 11/2007 | Moon et al. | |
| 2008/0303290 | A1 | 12/2008 | Yuan | |
| 2008/0314100 | A1 * | 12/2008 | Min | E05B 47/0603 70/278.1 |

* cited by examiner

SWING BOLT LOCK MECHANISM FOR PREVENTING PREMATURE STATUS SWITCH ENABLING

PRIORITY CLAIM TO RELATED APPLICATIONS

This application is a national phase application under 35 U.S.C. § 371 of International Application No. PCT/US2013/035130, filed Apr. 3, 2013. The entire content of the above-referenced disclosure is incorporated herein by reference without disclaimer.

TECHNICAL FIELD

The application relates to a swing bolt lock mechanism for preventing premature status switch enabling whereby an indication that the lock is in a locked position can only be provided when the swing bolt is fully at its locked position.

BACKGROUND OF THE ART

Current swing bolt locks operate in a way such that the switch monitoring the lock status can prematurely toggle before the swing bolt lock is completely relocked. This is due to the way in which the linear blocker rod slides. The lock can only relock once the linear blocker rod travels far enough to block the return of the swing bolt. Somewhere along the displacement of the linear blocker rod and the displacement of the swing bolt the switch can toggle to cause a false "locked" signal prior to the return of the swing bolt to the fully locked position. Reference is made to U.S. Pat. No. 7,461,872 which illustrates a mechanism of a motorized swing bolt lock provided with a spring-biased blocker rod.

SUMMARY

It is a feature of the present invention to provide a swing bolt lock mechanism which overcomes the above-mentioned disadvantage of the prior art.

Another feature of the present invention is to provide a swing bolt lock mechanism wherein a ramp extension arm is integrally connected with the swing bolt to extend the length of the ramp wall of the swing bolt to prevent the blocker rod from premature displacement.

According to the above features, from a broad aspect, the present invention provides a swing bolt lock mechanism which comprises a lock housing. A swing bolt is pivotally secured in the housing and has a locking portion displaceable in and out of the housing between an unlocked and a locked position. A blocker rod having an arresting head formation is spring-biased against a ramp wall of the swing bolt. An engageable abutment is provided at an end of the ramp wall. A ramp extension arm is displaceably secured with respect to the swing bolt and spring-biased to provide an extension of the ramp wall beyond the engageable abutment and disposed for contact by the arresting head of the blocker rod. The ramp extension arm has an abutment free end. The ramp extension arm obstructs the displacement of the blocker rod until the swing bolt is displaced to the fully locked position and the abutment free end of the ramp extension arm is aligned with the arresting head of the blocker rod causing the blocker rod to be displaced for arresting engagement with the engageable abutment at the end of the ramp wall. The blocker rod, when reaching the arresting engagement, actuates a lock status switch to provide an indication of the locked condition.

DESCRIPTION OF THE DRAWINGS

A preferred embodiment of the present invention will now be described with reference to the accompanying drawings in which.

DETAILED DESCRIPTION

Figure 1A:
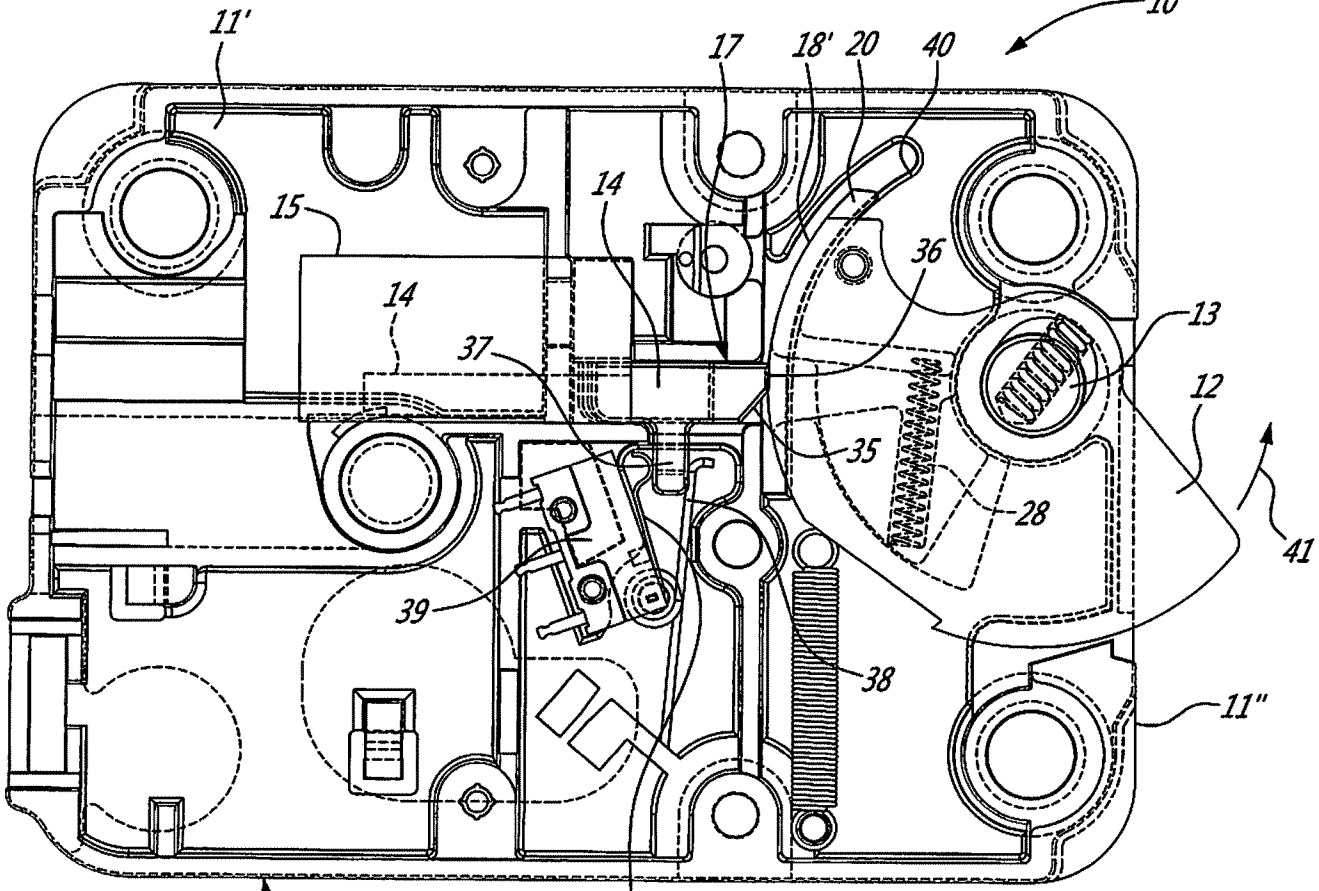
FIGS. 1A, 1B and 1C are side views of the lock housing interior illustrating various positions of the swing bolt lock mechanism of the present invention from an unlocked position to a fully locked position.
Figure 1B:
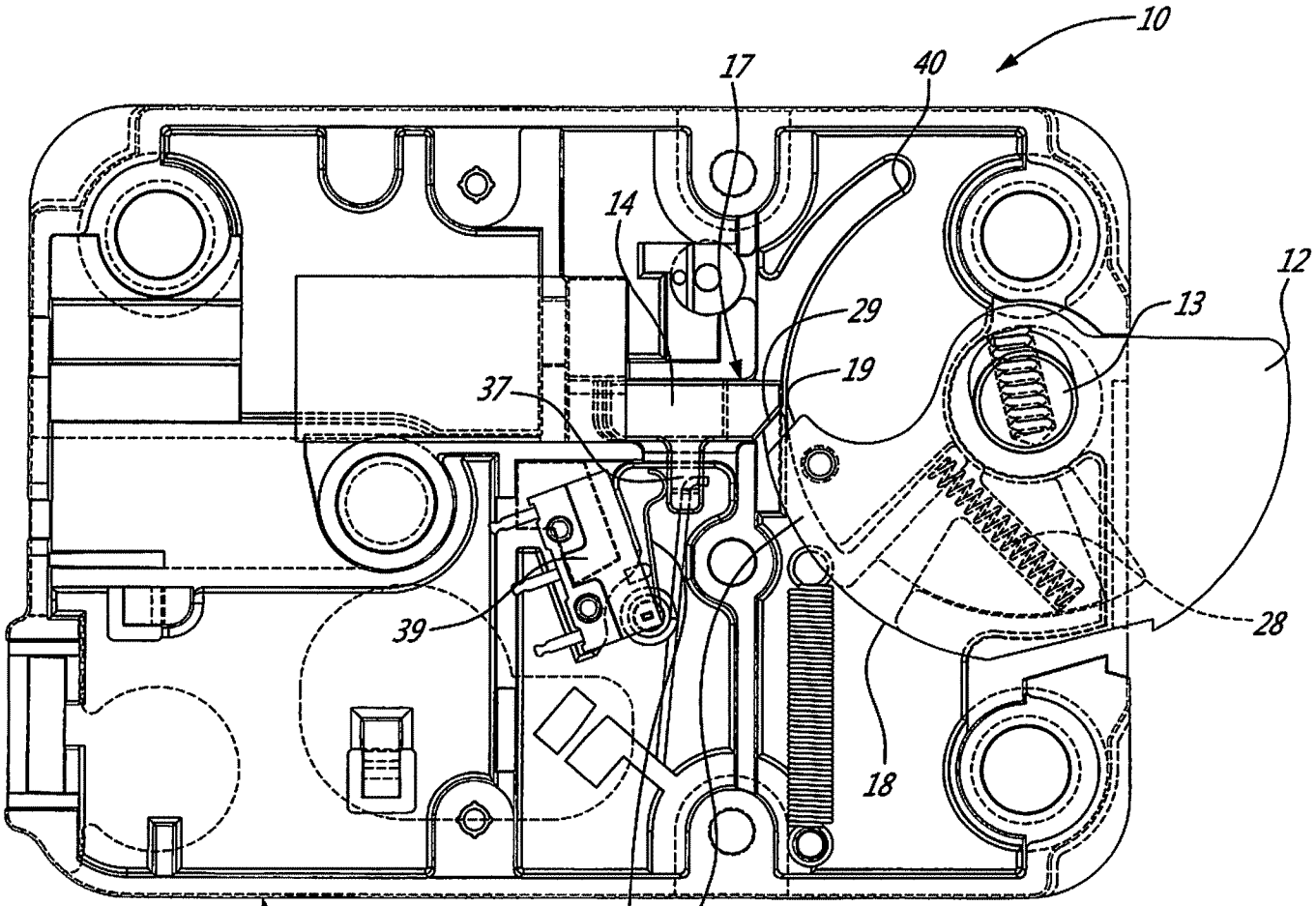
Figure 1C:
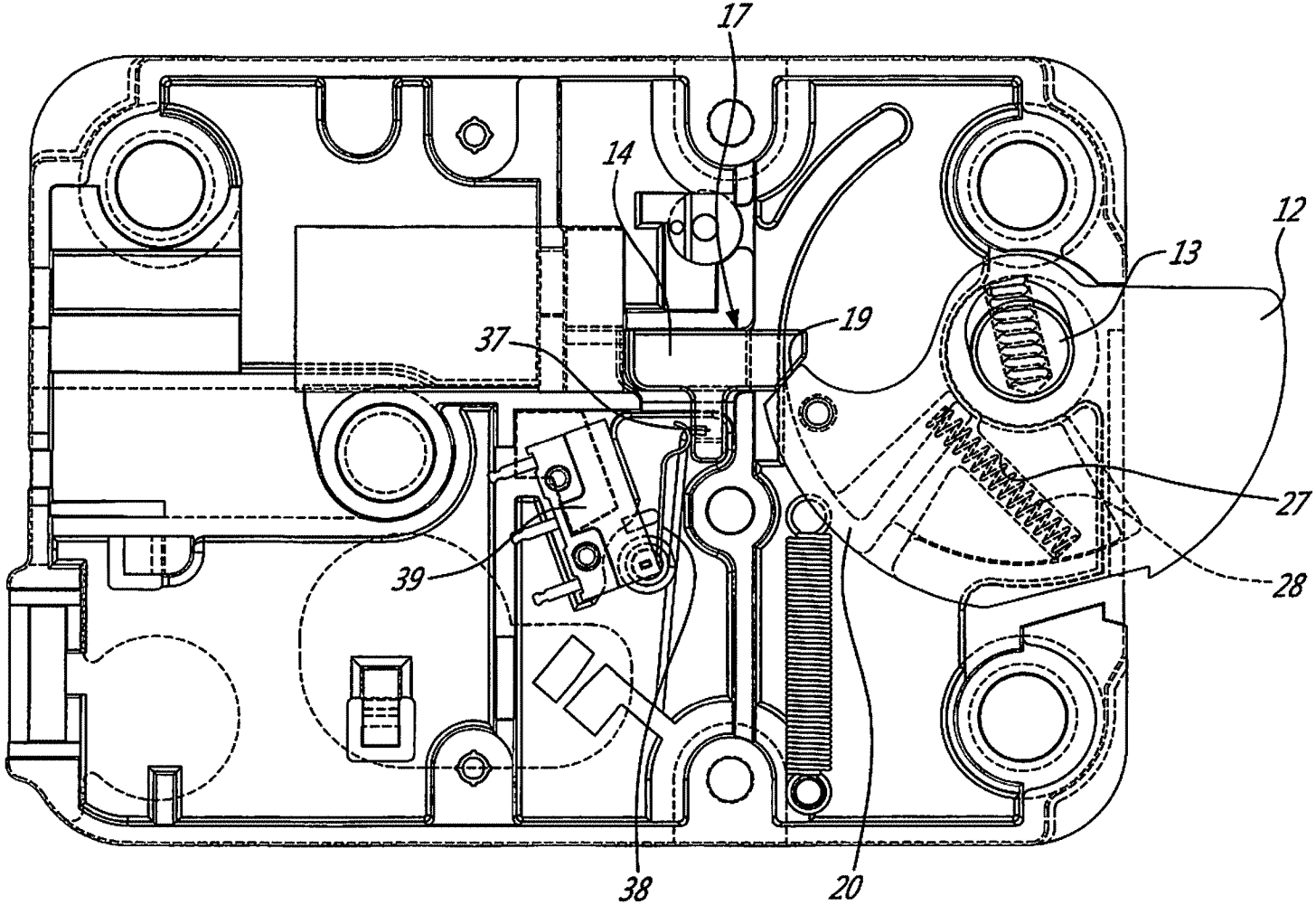

Referring now to FIGS. 1A to 1C, there is shown generally at 10 the swing bolt lock of the present invention. The swing bolt lock has a mechanism which is secured within a lock housing 11. It comprises a swing bolt 12, the construction of which is more clearly illustrated in FIG. 2, which is pivotally secured on a pivot connection 13, the specific arrangement of this pivot connection being well known in the art and not forming part of the present invention, wherein the swing bolt 12 can be displaced from an unlocked position, wherein the swing bolt is fully retracted within the housing 11, to a fully locked position as indicated in FIG. 1C.

A blocker rod 14 is slidingly secured within a housing 15 or between guide walls disposed in opposed side walls of the housing 11 and spring-biased outside the housing 15 by a torsion spring 16. The blocker rod has an arresting head 17 which is spring-biased against a ramp wall 18 of the swing bolt 12. As herein shown the ramp wall 18 is an arcuate ramp wall.

Figure 2:
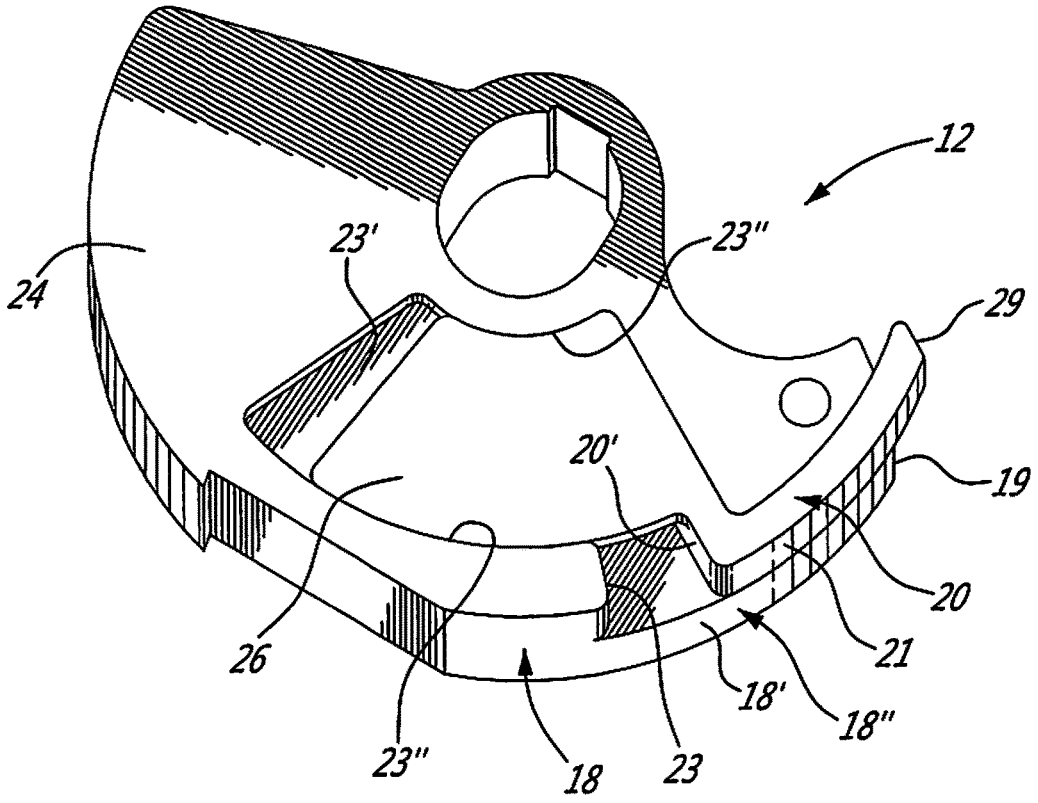
FIG. 2 is a perspective view showing the construction of the swing bolt incorporating therein the ramp extension arm construction.
Figure 3:
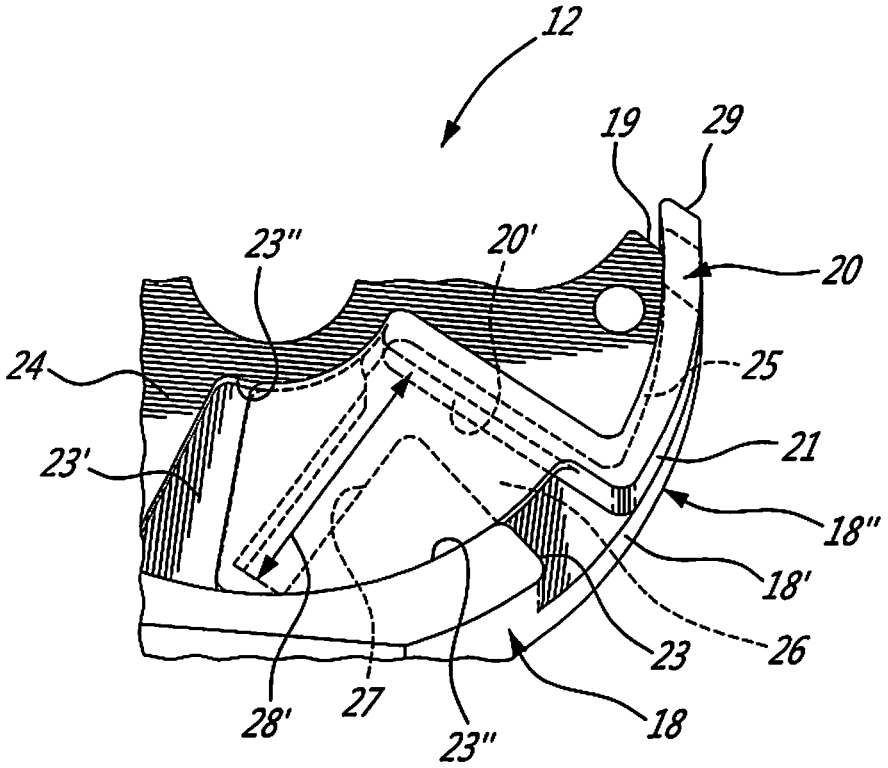
FIG. 3 is an enlarged and fragmented perspective view showing the cavity formed in the swing bolt side wall and the shape and construction of the ramp extension arm and its displaceable support body portion disposed in a cavity of the side wall of the swing bolt.

With further reference to FIGS. 2 and 3, it can be seen that the ramp wall 18 of the swing bolt has an angulated engageable abutment 19 at an end of the ramp wall. A ramp extension arm 20 is displaceably secured with respect to the swing bolt 12 and spring-biased to provide an extension of the ramp wall 18 beyond the engageable abutment end 19 and is disposed for contact by the arresting head 17 of the blocker rod 14. The ramp extension arm 20 also has a ramp face 21 which extends flush with the ramp wall surface 18' of the ramp wall 18. The ramp face 21 and the ramp wall surface 18' are flat arcuate surfaces.

As better shown in FIGS. 2 and 3, the swing bolt 12 has a shaped cavity 23 formed in a side wall 24 thereof in an inner portion of the swing bolt located within the housing 11 wherein the cavity 23 remains substantially within the housing when the swing bolt 12 is at its fully locked position, as shown in FIG. 1C. The cavity 23 also merges in an open slot 25 formed along an inner leading edge portion 18" of the ramp wall 18. The cavity 23 defines a flat plateau portion 23' on which is supportingly displaced captive between the cavity side walls 23" a flat support body portion 26 of the ramp extension arm 20. The body portion 26 is configured for close sliding fit on the cavity flat plateau portion 23'.

As shown in FIG. 3, the body portion 26 is shown transparent. The cavity 23 also defines a compression spring retention channel to receive captive therein a compression spring 28, indicated by arrow 28' in FIG. 3, abutting against an inner wall 20' of the ramp extension arm 20 to bias forwardly as illustrated in FIGS. 2 and 3, to a ramp wall extended position as shown in FIG. 2. Accordingly, the ramp extension arm 20 is in its position as illustrated in FIGS. 2 and 3 when the lock is in an unlocked position. It is also pointed out that the support body portion 26 is dimensioned for displacement within the cavity 23 to accommodate the full displacement of the ramp arm 20 rearwardly whereby an abutment free end 29 of the ramp extension arm can be pushed back by the arresting head 17 of the blocker rod 14 to extend co-extensive with the engagement abutment 19 at the end of the ramp wall 18, as will be described later, when describing the operation of the swing bolt lock.

The support body portion 26 of the ramp extension is retained captive by rib formations formed in the side wall of the housing which has been removed from FIGS. 1A to 1C and this is obvious to a person skilled in the art. The spring 28 is retained captive by the support body portion 26.

As can be seen from FIGS. 1A to 1C, the blocker rod 14 has an angulated pusher face section 35 for sliding engagement with the abutment free end 29 of the ramp arm which is also sloped and the engageable abutment 19 of the ramp wall also having a slope extending parallel to the slope of the abutment free end 29 of the ramp extension arm 20. The arresting head 17 also has a blunt section 36 disposed above the angulated pusher face section 35 for abutment against the ramp surface 18' of the ramp wall 18 and the ramp face 21 of the ramp extension arm 20.

As also illustrated in FIGS. 1A to 1C, the blocker rod 14, which is a linear sliding rod, is provided with a switch actuating finger 37 which depends therefrom and spaced rearwardly of the arresting head 17. This actuating finger 37 extends for engagement with a toggle arm 38 of a lock status switch 39. The lock status switch 39 is connected to a suitable status indication means to enable a visual or audible indicator of the status of the lock. When the toggle arm 38 is fully depressed, the status switch provides for an indication that the swing bolt lock is disabled, it is in an unlocked position. When the toggle arm 38 is fully released, such as illustrated in FIG. 1C, the status switch provides an indication that the lock is in its fully locked condition.

Referring now to FIGS. 1A and 1B, there will be described the operation of the swing bolt lock mechanism of the present invention. It is pointed out that the swing bolt is displaced on its pivot connection 13 by suitable means, well known in the art, such as by a mechanical actuator, an electric motor, etc. FIG. 1A illustrates the swing bolt initially being displaced towards its lock position. However, when the swing bolt 12 is fully retracted, the arresting head 17 of the blocker rod 14 is biased against the surface 18' of the ramp wall 18 with the ramp arm 20 having been pushed inwardly within a ramp arm accommodating arcuate cavity 40 formed in the side wall 11' of the housing 11. Accordingly, the blocker rod is arrested against the ramp wall 18. As the swing bolt continues to be displaced in the direction of arrow 41, outwardly of the side edge 11" of the housing 11, the arresting head 17 abuts both the ramp face 21 of the ramp extension arm 20 and the surface 18' of the ramp wall 18. As the swing bolt is continuously displaced towards its lock position, as illustrated in FIG. 1B and the arresting head 17 of the blocker rod 14 only abuts the ramp face 21 of the ramp extension arm 20 with the engageable abutment 19 having cleared the arresting head 17, the pusher face section 35 of the arresting head 17 starts sliding onto the abutment free end 29 of the ramp extension arm 20 and applying a spring force against the compression spring 28 thereby displacing the support body portion 26 on the flat plateau portion 23' of the cavity 23 and retracting the ramp extension arm 20 until the abutment free end 29 of the ramp extension arm 20 aligns with the engageable abutment 19 of the ramp wall. The pusher face 35 then continues to slide onto the sloped surface of the engageable abutment 19 until it reaches its locked position, as illustrated in FIG. 1C. It is pointed out that the force exerted by the torsion spring 16 on the blocker rod 14 is greater than the force of the compression spring 28. It is only at that moment when the pusher face 35 of the blocker rod reaches its final position on the engageable abutment 19 that the switch actuating finger 37 has been displaced forwardly enough to release the toggle arm 38 of the lock status switch 39. Accordingly, the switch initiates an indication of the lock condition only at that moment when the swing bolt has been displaced to its maximum lock position thereby preventing any false and premature switch enabling.

It is within the ambit of the present invention to cover any obvious modifications of the preferred embodiment described herein provided such modifications fall within the scope of the appended claims.

What is claimed is:

1. A swing bolt lock mechanism comprising a lock housing, a swing bolt pivotally secured in said lock housing and having a locking portion displaceable in and out of said lock housing between an unlocked and a locked position, a blocker rod having an arresting head formation spring-biased against a ramp wall of said swing bolt, an engageable abutment at an end of said ramp wall, a ramp extension arm displaceably secured with respect to said swing bolt and spring-biased to provide an extension of said ramp wall beyond said engageable abutment and disposed for contact by said arresting head formation, said ramp extension arm having an abutment free end, said ramp extension arm obstructing the displacement of said blocker rod until said swing bolt is displaced to said locked position and said abutment free end of said ramp extension arm is aligned with said arresting head formation of said blocker rod, causing said blocker rod to be displaced for arresting engagement with said engageable abutment at said end of said ramp wall; said blocker rod, when reaching said arresting engagement, actuating a lock status switch to provide an indication of said locked position of said swing bolt, wherein said ramp extension arm has a ramp face extending flush with said ramp wall.

2. The swing bolt lock mechanism as claimed in claim 1, wherein said swing bolt has a cavity formed therein, with a portion of said cavity merging in an open slot along an inner leading edge portion of said ramp wall, said ramp extension arm having a support body portion slidingly disposed captive in said cavity for limited displacement therein, with displacement of said ramp extension arm in said open slot of said inner leading edge portion of said cavity.

3. The swing bolt lock mechanism as claimed in claim 2, wherein said cavity is formed in a side wall of said swing bolt in an inner end portion of said swing bolt, wherein said cavity remains substantially in said lock housing when said swing bolt is in its locked position.

4. The swing bolt lock mechanism as claimed in claim 2, wherein said ramp extension arm is spring-biased to a ramp wall extending position by a compression spring housed within said cavity, wherein when in said ramp wall extending position, an end portion of said ramp extension arm projects beyond said engageable abutment of said ramp wall, and thereby, provides the extension of said ramp wall beyond said engageable abutment.

5. The swing bolt lock mechanism as claimed in claim 4, wherein said blocker rod is a linear slide rod, wherein said arresting head formation of said blocker rod includes a free end formation spring-biased against said ramp wall and said ramp face of said ramp extension arm by a torsion spring.

6. The swing bolt lock mechanism as claimed in claim 5, wherein said free end formation of said blocker rod has an angulated pusher face section for sliding engagement with said abutment free end of said ramp extension arm and said engageable abutment of said ramp wall.

7. The swing bolt lock mechanism as claimed in claim 6, wherein said free end formation has a blunt section disposed above said angulated pusher face section for abutment against said ramp face of said ramp extension arm and said ramp wall of said swing bolt when said swing bolt is retracted to said unlocked position.

8. The swing bolt lock mechanism as claimed in claim 5, wherein said linear slide rod has a switch actuating finger for engaging a toggle arm of said lock status switch.

9. The swing bolt lock mechanism as claimed in claim 5, wherein said linear slide rod has a spring engageable end displaceably retained captive in a slide housing.

10. The swing bolt lock mechanism as claimed in claim 2, wherein said ramp wall is an arcuate ramp wall, said ramp face of said ramp extension arm is an arcuate ramp face, said open slot formed along an inner leading edge portion of said ram wall extending to said engageable abutment of said ramp wall.

11. The swing bolt lock mechanism as claimed in claim 1, wherein said swing bolt is displaceable in and out of said lock housing by one of an electric motor or a mechanical actuator.

* * * * *